US011585134B2

(12) United States Patent
Moe

(10) Patent No.: US 11,585,134 B2
(45) Date of Patent: Feb. 21, 2023

(54) MORTISE JIG ASSEMBLY

(71) Applicant: Malcolm Moe, Baldwin, NY (US)

(72) Inventor: Malcolm Moe, Baldwin, NY (US)

( * ) Notice: Subject to any disclaimer, the term of this patent is extended or adjusted under 35 U.S.C. 154(b) by 372 days.

(21) Appl. No.: 16/990,326

(22) Filed: Aug. 11, 2020

(65) Prior Publication Data

US 2022/0049530 A1 Feb. 17, 2022

(51) Int. Cl.
*E05D 11/00* (2006.01)
*E04F 21/00* (2006.01)

(52) U.S. Cl.
CPC ..... *E05D 11/0009* (2013.01); *E04F 21/003* (2013.01)

(58) Field of Classification Search
CPC ..... E05D 11/009
USPC ..... 33/194, 197
See application file for complete search history.

(56) References Cited

U.S. PATENT DOCUMENTS 577,752 A 2/1897 Hoerr
2,832,381 A 4/1958 Sherwood
3,880,543 A 4/1975 Gillett
4,407,344 A * 10/1983 Dicke ..... B27F 1/12 33/562
5,123,463 A 6/1992 Grisley
5,154,214 A * 10/1992 Hagerman ..... B27F 5/12 144/144.51
5,285,832 A * 2/1994 Gibson ..... B27F 1/12 144/144.51
5,494,089 A 2/1996 Lubbe
6,032,706 A 3/2000 Lear
7,455,089 B2 * 11/2008 McDaniel ..... B27F 1/12 144/144.1
8,549,766 B2 * 10/2013 Katayama ..... F16H 55/26 33/501.11
10,876,334 B2 * 12/2020 Santiago ..... E05D 11/0009
2011/0064531 A1 * 3/2011 Osborne ..... B23B 49/023 408/103

* cited by examiner

*Primary Examiner* — George B Bennett

(57) ABSTRACT

A mortise jig assembly includes a block that is longitudinally elongated. The block has plurality of mortises therein and the block is clamped to a face of a door such that selected ones the mortises is aligned with an edge of the door. A jig panel is provided and the jig panel is positionable against the edge of the door to engage respective ones of the mortises thereby retaining the jig panel at a selected location on the edge of the door. The jig panel has a guide hole therein thereby facilitating the guide hole to be aligned with a preferred location to cut a hinge recess in the edge of the door. A pair of bolts is each extendable through the jig panel and the block for attaching the jig panel to the block.

12 Claims, 5 Drawing Sheets

MORTISE JIG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to jig devices and more particularly pertains to a new jig device for precisely locating a hinge recess in a door.

(2) Description of Related Art Including Information Disclosed Under 37 CFR 1.97 and 1.98

The prior art relates to jig devices including a jig for a tuning bridge of piano. The prior art discloses a jig for spacing two members apart for precisely locating a hinge to coupled the two members together. The prior art discloses a jig for locating holes to be drilled into wood for sinking a mortise. The prior art discloses a jib for precisely locating a hinge recess in the door that is cut with a power tool. The prior art discloses a mortise and tenon jig for a router. Additionally, the prior art discloses a woodworking jig for guiding a router for routing a groove into a member.

BRIEF SUMMARY OF THE INVENTION

An embodiment of the disclosure meets the needs presented above by generally comprising a block that is longitudinally elongated. The block has plurality of mortises therein and the block is clamped to a face of a door such that selected ones the mortises is aligned with an edge of the door. A jig panel is provided and the jig panel is positionable against the edge of the door to engage respective ones of the mortises thereby retaining the jig panel at a selected location on the edge of the door. The jig panel has a guide hole therein thereby facilitating the guide hole to be aligned with a preferred location to cut a hinge recess in the edge of the door. A pair of bolts is each extendable through the jig panel and the block for attaching the jig panel to the block.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
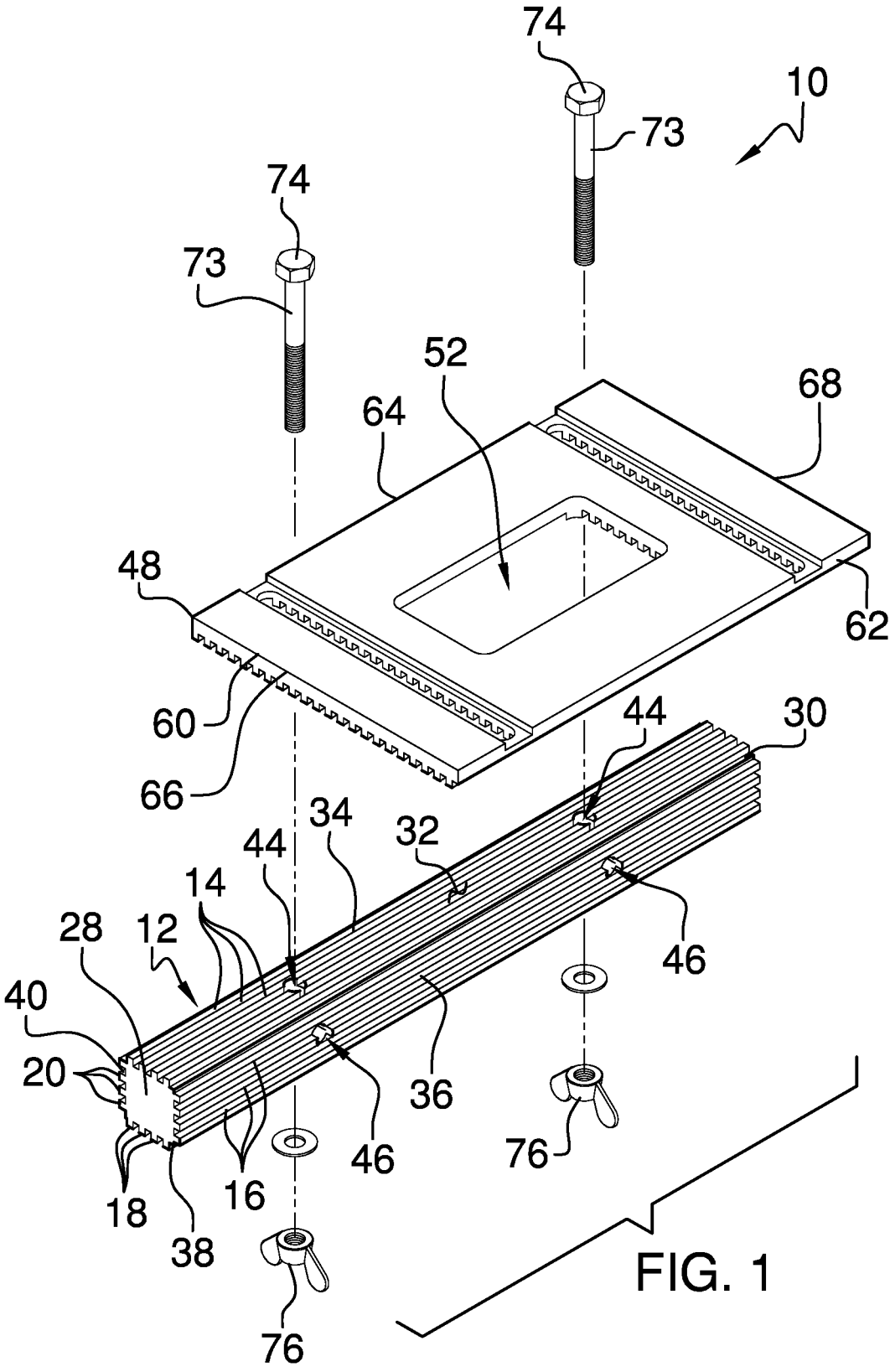
FIG. 1 is an exploded perspective view of a mortise jig assembly according to an embodiment of the disclosure.
Figure 2:
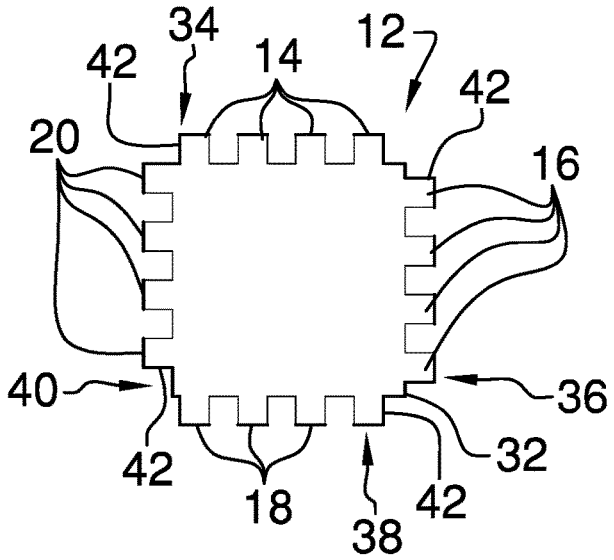
FIG. 2 is a right side view of a block of an embodiment of the disclosure.
Figure 3:
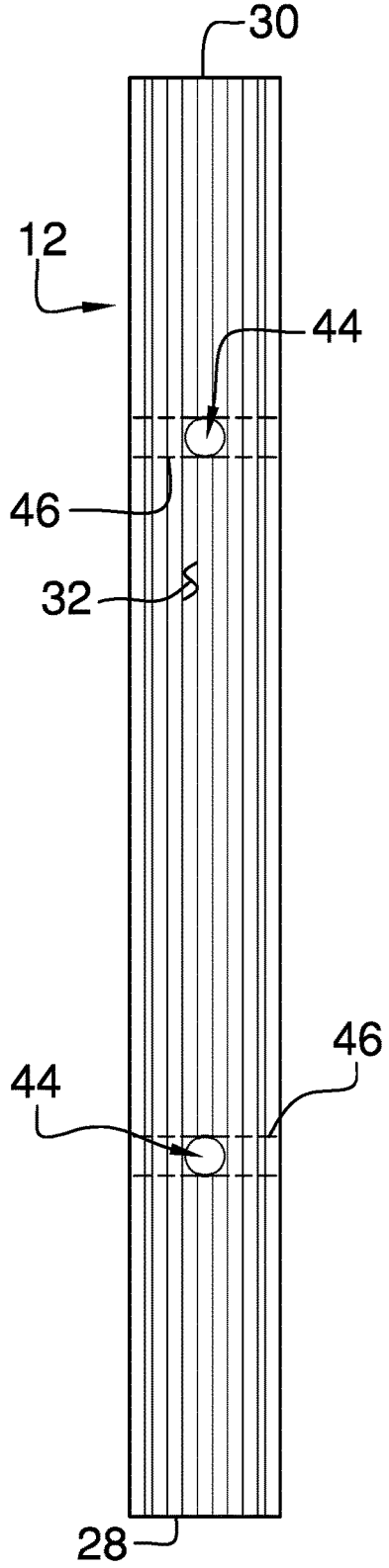
FIG. 3 is a top view of a block of an embodiment of the disclosure.
Figure 4:
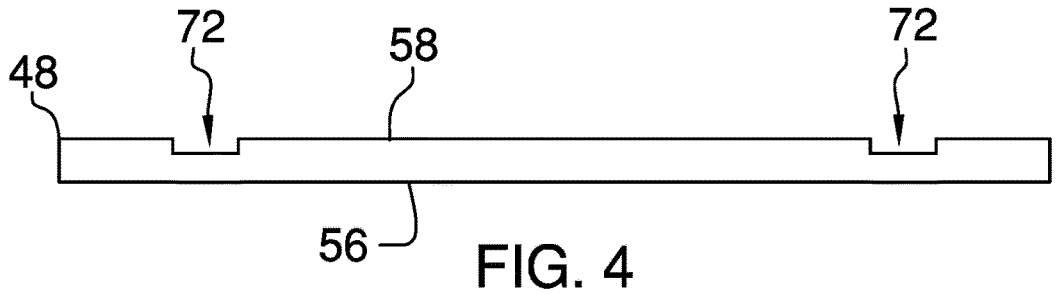
FIG. 4 is a front view of a jig panel of an embodiment of the disclosure.
Figure 5:
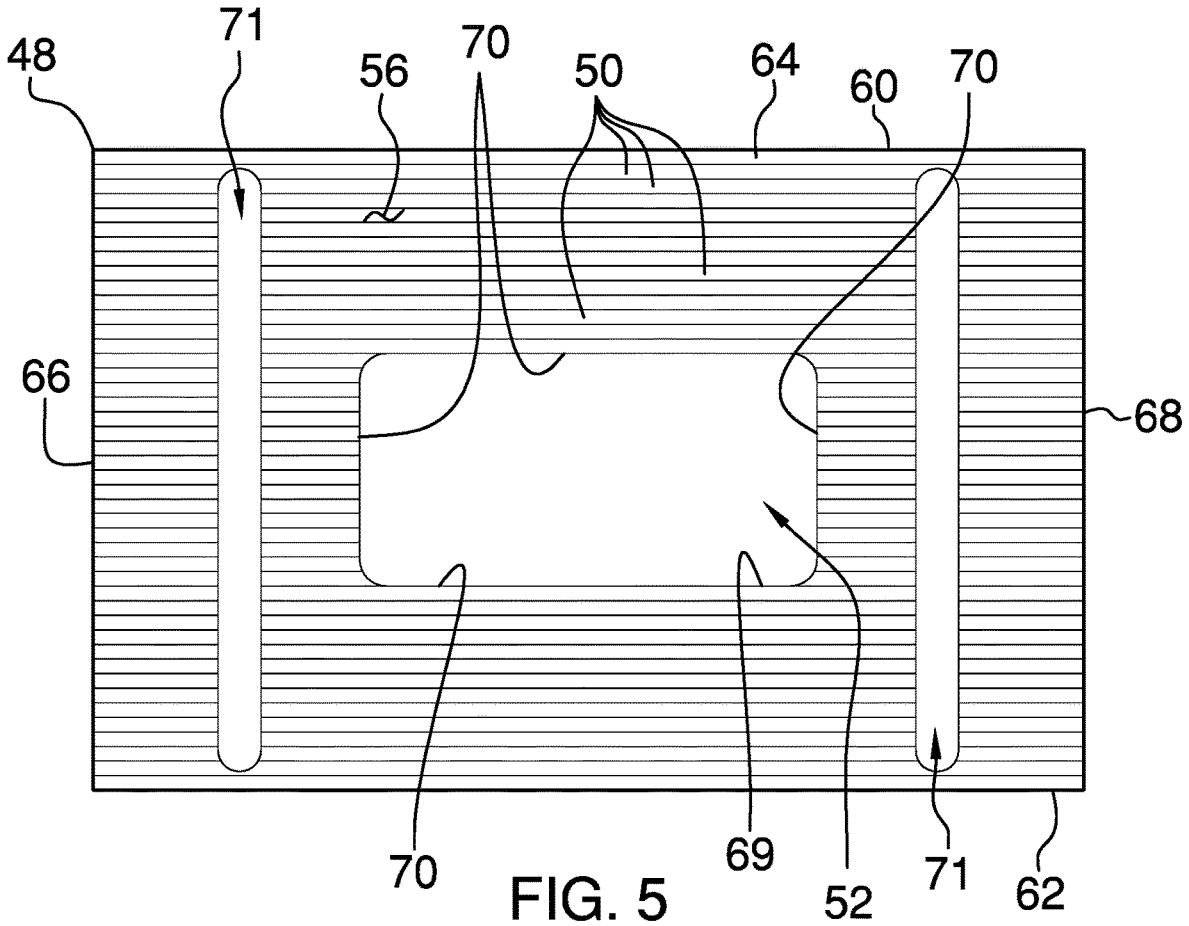
FIG. 5 is a bottom view of a jig panel of an embodiment of the disclosure.
Figure 6:
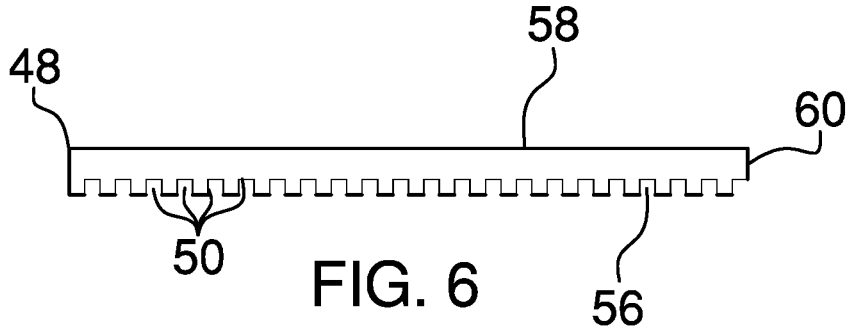
FIG. 6 is a right side view of a jig panel of an embodiment of the disclosure.
Figure 7:
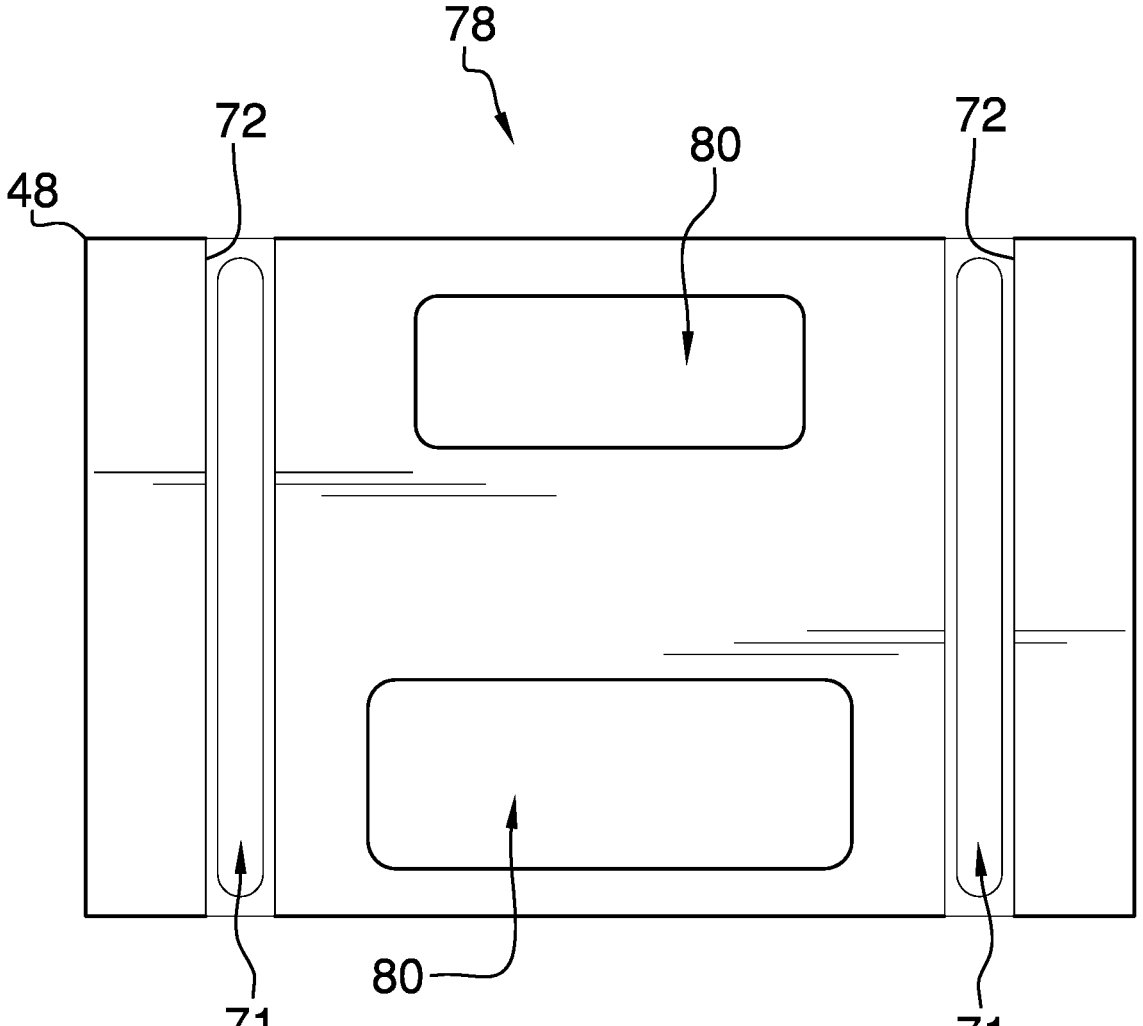
FIG. 7 is a top view of an alternative embodiment of the disclosure.
Figure 8:
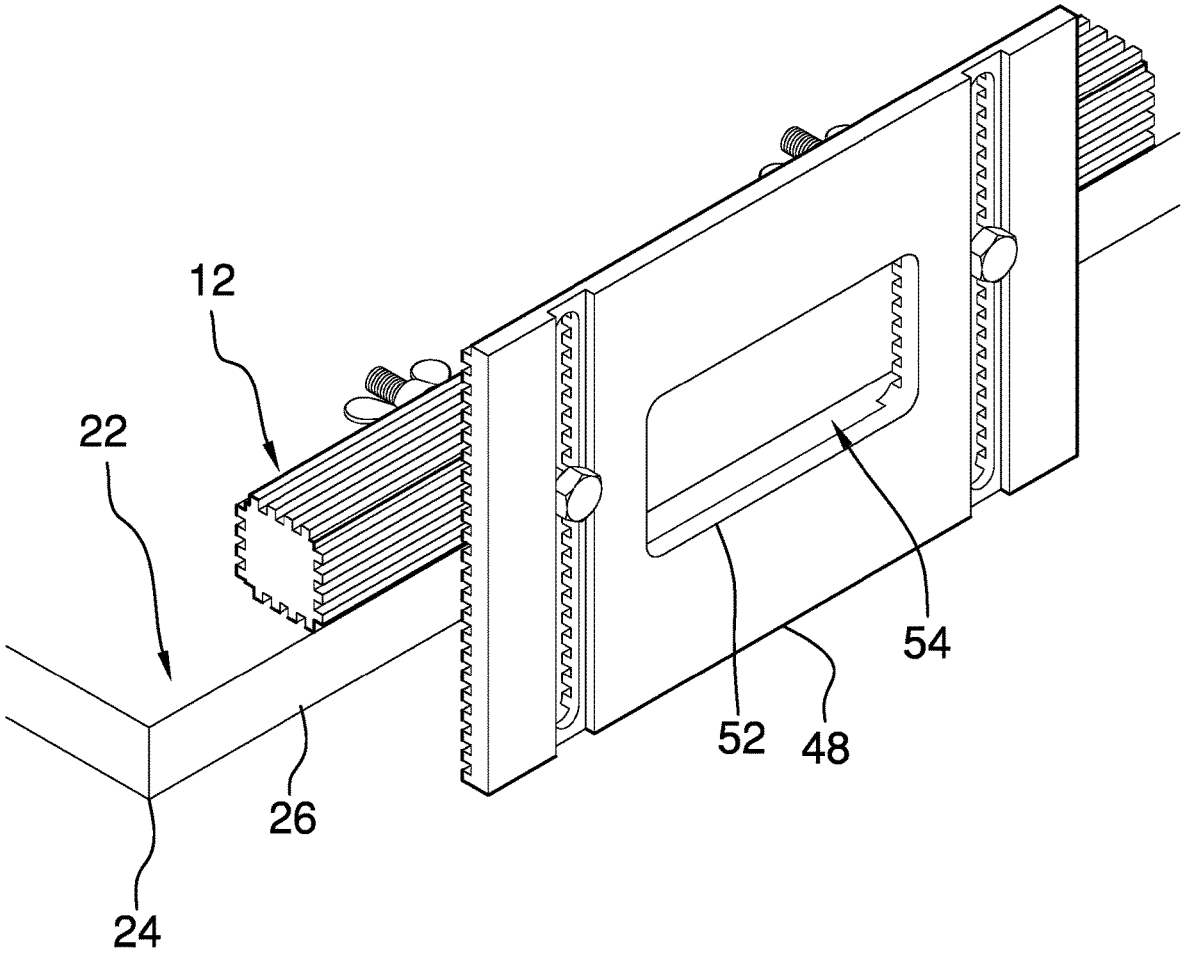
FIG. 8 is a perspective in-use view of an embodiment of the disclosure.

With reference now to the drawings, and in particular to FIGS. 1 through 8 thereof, a new jig device embodying the principles and concepts of an embodiment of the disclosure and generally designated by the reference numeral 10 will be described.

As best illustrated in FIGS. 1 through 8, the mortise jig assembly 10 generally comprises a block 12 that is longitudinally elongated. The block 12 has a first set of mortises 14, a second set of mortises 16, a third set of mortises 18 and a fourth set of mortises 20. Each of the first set of mortises 14, the second set of mortises 16, the third set of mortises 18 and the fourth set of mortises 20 has a unique offset distance with respect to each other. The block 12 is clamped to a face 22 of a door 24 having the block 12 being aligned with an edge 26 of the door 24. Moreover, the block 12 is positioned such that a selected one of the first set of mortises 14, the second set of mortises 16, the third set of mortises 18 or the fourth set of mortises 20 is aligned with the face 22 of the door 24. The door 24 may be an interior door or an exterior door that is being prepared for installation in a doorway of a house or other similar building.

The block 12 has a first end 28, a second end 30 and an outer surface 32 extending therebetween, and the outer surface 32 has a first side 34, a second side 36, a third side 38 and a fourth side 40. Additionally, the block 12 is elongated between the first end 28 and the second end 30. The first side 34 is oriented at a right angle with respect to the second side 36, and the second side 36 is oriented at a right angle with respect to the third side 38. Moreover, the third side 38 is oriented at a right angle with respect to the fourth side 40 and the fourth side 40 is oriented at a right angle with respect to the first side 34. The first set of mortises 14 is recessed into the first side 34, the second set of mortises 16 is recessed into the second side 36, the third set of mortises 18 is recessed into the third side 38, and the fourth set of mortises 20 is recessed into the fourth side 40.

Each of the first set of mortises 14, the second set of mortises 16, the third set of mortises 18 and the fourth set of mortises 20 extends between the first end 28 and the second end 30 of the block 12. Additionally, each of the first set of mortises 14, the second set of mortises 16, the third set of mortises 18 and the fourth set of mortises 20 including a reference mortise 42. The reference mortise 42 of the first set of mortises 14 is oriented flush with an intersection between the first side 34 and the fourth side 40 of the outer surface 32. The reference mortise 42 of the second set of mortises 16 is offset 1/32 inch from an intersection between the second side 36 and the first side 34. The reference mortise 42 of the third set of mortises 18 is offset 1/16 inch from an intersection between the third side 38 and the second side 36. Finally, the reference mortise 42 of the fourth set of mortises 20 is offset 3/32 inch from an intersection between the third side 38 and the fourth side 40.

Each of the first set of mortises 14 is spaced apart 1/8 inch from each other, and each of the second set of mortises 16 is spaced apart 1/8 inch from each other. Each of the third set of mortises 18 is spaced apart 1/8 inch from each other, and each of the fourth set of mortises 20 is spaced apart 1/8 from each other. The block 12 has a pair of first holes 44 each extending through the first side 34 and the third side 38. The block 12 has a pair of second holes 46 each extending through the second side 36 and the fourth side 40. Additionally, each of the second holes 46 interests a respective one of the first holes 44.

A jig panel 48 is provided that has a plurality of jig mortises 50 recessed therein. The jig panel 48 is positionable against the edge 26 of the door 24 having the jig mortises 50 engaging respective ones of the first set of mortises 14, the second set of mortises 16, the third set of mortises 18 or the fourth set of mortises 20 in the block 12. In this way the jig panel 48 is retained at a selected location on the edge of the door 24. The jig panel 48 has a guide hole 52 therein thereby facilitating the guide hole 52 to be aligned with a preferred location to cut a hinge recess 54 in the edge 26 of the door 24. In this way the block 12 and the jig panel 48 facilitate the hinge recess 54 to be precisely located on the edge of the door 24.

The jig panel 48 has a bottom surface 56, a top surface 58 and a perimeter edge 60 extending therebetween, and the perimeter edge 60 has a front side 62, a back side 64, a first lateral side 66 and a second lateral side 68. The plurality of jig mortises 50 is recessed into the bottom surface 56 of the jig panel 48 and each of the jig mortises 50 extends between the first lateral side 66 and the second lateral side 68. Moreover, the jig mortises 50 are spaced apart from each other and are distributed between the front side 62 and the back side 64. Each of the jig mortises 50 is spaced 1/8 inch apart from each other thereby facilitating each of the jig mortises 50 to engage either the first set of mortises 14, the second set of mortises 16, the third set of mortises 18 or the fourth set of mortises 20.

The guide hole 52 extends through the top surface 58 and the bottom surface 56 of the jig panel 48, and the guide hole 52 is centrally positioned on the jig panel 48. The guide hole 52 has a bounding edge 69 and the bounding edge 69 has a plurality of intersecting sides 70 such that the guide hole 52 has a rectangular shape. The guide hole 52 is spaced from the face 22 of the door 24 a distance corresponding to the offset of either the first set of mortises 14, the second set of mortises 16, the third set of mortises 18 or the fourth set of mortises 20. The jig panel 48 has a pair of slots 71 each extending through the top surface 58 and the bottom surface 56. Each of the slots 71 extends substantially between the front side 62 and the back side 64 of the perimeter edge 60 of the jig panel 48. Each of the slots 71 is positioned between the guide hole 52 and a respective one of the first lateral side 66 and the second lateral side 68. Moreover, each of the slots 71 is aligned with a respective one of the first holes 44 or the second holes 46 when the jig panel 48 is positioned on the block 12.

The top surface 58 has a pair of channels 72 each extending toward the bottom surface 56 of the jig panel 48, and each of the channels 72 extends between the front side 62 and the back side 64. Each of the channels 72 is aligned with a respective one of the slots 71 and each of the channels 72 is oriented collinear with the respective slot 64. A pair of bolts 73 is provided and each of the bolts 73 is extendable through the jig panel 48 and the block 12 for attaching the jig panel 48 to the block 12. Each of the bolts 73 is extendable through a respective one of the slots 71 having the bolts 73 extending fully through the respective first hole 44 or the respective second hole 46 in the block 12 that is aligned with the respective slot 64. Each of the channels 72 in the jig panel 48 accommodates a head 74 of the bolts 73 when the bolts 73 are extended through the respective slot 64 thereby facilitating the head 74 of each of the bolts 73 to be spaced downwardly from the top surface 58 of the jig panel 48. A pair of nuts 76 is each threadable onto a respective one of the bolts 73 when the bolts 73 are extended through the jig panel 48 and the block 12 for retaining the block 12 on the jig panel 48. In an alternative embodiment 78 as is most clearly shown in FIG. 7, the jig panel 48 may have a pair of guide holes 80 extending therethrough and each of the guide holes 80 may have a unique perimeter with respect to each other.

In use, the block 12 is clamped on the face 22 of the door 24 such that a selected one of the first set of mortises 14, the second set of mortises 16, the third set of mortises 18 or the fourth set of mortises 20 is aligned with the edge 26 of the door 24. The jig panel 48 is positioned against the edge of the door 24 such that the jig mortises 50 engage the block 12. Each of the bolts 73 is extended through the slots 71 to engage the respective first holes 44 or second holes 46 in the block 12 and the nuts 76 are threaded onto the bolts 73 to retain the jig panel 48 on the block 12. In this way the guide hole 52 is precisely located on the edge of the door 24. Thus, a router or other type of tool can be employed to carve out the hinge recess 54 in the guide hole 52, thereby precisely locating the hinge recess 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mortise jig assembly for accurately positioning a recess in a door edge for a hinge plate, said assembly comprising:

a block being longitudinally elongated, said block having a first set of mortises, a second set of mortises, a third set of mortises and a fourth set of mortises, each of said first set mortises, said second set of mortises, said third set of mortises and said fourth set of mortises having a unique offset distance with respect to each other, said block being clamped to a face of a door having said block being aligned with an edge of the door such that a selected one of said first set of mortises, said second set of mortises, said third set of mortises or said fourth set of mortises is aligned with the edge of the door;

a jig panel having a plurality of jig mortises being recessed therein, said jig panel being positionable against the edge of the door having said jig mortises engaging respective ones of said first set of mortises, said second set of mortises, said third set of mortises or said fourth set of mortises in said block thereby retaining said jig panel at a selected location on the edge of the door, said jig panel having a guide hole therein thereby facilitating said guide hole to be aligned with a preferred location to cut a hinge recess in the edge of the door wherein said block and said jig panel are configured to precisely locate the hinge recess on the edge of the door; and a pair of bolts, each of said bolts being extendable through said jig panel and said block for attaching said jig panel to said block.

2. The assembly according to claim 1, wherein said block has a first end, a second end and an outer surface extending therebetween, said outer surface having a first side, a second side, a third side and a fourth side, said block being elongated between said first end and said second end, said first side being oriented at a right angle with respect to said second side, said second side being oriented at a right angle with respect to said third side, said third side being oriented at a right angle with respect to said fourth side, said fourth side being oriented at a right angle with respect to said first side.

3. The assembly according to claim 2, wherein said first set of mortises is recessed into said first side, said second set of mortises being recessed into said second side, said third set of mortises being recessed into said third side, said fourth set of mortises being recessed into said fourth side, each of said first set of mortises, said second set of mortises, said third set of mortises and said fourth set of mortises extending between said first end and said second end of said block.

4. The assembly according to claim 2, wherein said block has a pair of first holes each extending through said first side and said third side, said block having a pair of second holes each extending through said second side and said fourth side, each of said second holes interesting a respective one of said first holes.

5. The assembly according to claim 1, wherein said jig panel has a bottom surface, a top surface and a perimeter edge extending therebetween, said perimeter edge having a front side, a back side, a first lateral side and a second lateral side, said plurality of jig mortises being recessed into said bottom surface, each of said jig mortises extending between said first lateral side and said second lateral side, said jig mortises being spaced apart from each other and being distributed between said front side and said back side.

6. The assembly according to claim 1, wherein each of said jig mortises is spaced apart from each other a sufficient distance thereby facilitating each of said jig mortises to engage either said first set of mortises, said second set of mortises, said third set of mortises or said fourth set of mortises.

7. The assembly according to claim 5, wherein said guide hole extends through said top surface and said bottom surface, said guide hole being centrally positioned on said jig panel, said guide hole having a bounding edge, said bounding edge having a plurality of intersecting sides such that said guide hole has a rectangular shape, said guide hole being spaced from the face of the door a distance corresponding to said offset of either said first set of mortises, said second set of mortises, said third set of mortises or said fourth set of mortises.

8. The assembly according to claim 7, wherein:

said block has a pair of first holes each extending therethrough;

said block has a pair of second holes each extending therethrough; and said jig panel had a pair of slots each extending through said top surface and said bottom surface, each of said slots extending substantially between said front side and said back side of said perimeter edge of said jig panel, each of said slots being positioned between said guide hole and a respective one of said first lateral side and said second lateral side, each of said slots being aligned with a respective one of said first holes or said second holes when said jig panel is positioned on said block.

9. The assembly according to claim 8, wherein said top surface has a pair of channels each extending toward said bottom surface, each of said channels extending between said front side and said back side, each of said channels being aligned with a respective one of said slots, each of said channels being oriented collinear with said respective slot.

10. The assembly according to claim 9, wherein each of said bolts is extendable through a respective one of said slots having said bolts extending fully through said respective first hole or said second hole in said block that is aligned with said respective slot, each of said channels in said jig panel accommodating a head of said bolts when said bolts are extended through said respective slot thereby facilitating said head of each of said bolts to be spaced downwardly from said top surface of said jig panel.

11. The assembly according to claim 1, further comprising a pair of nuts, each of said nuts being threadable onto a respective one of said bolts when said bolts are extended through said jig panel and said block for retaining said block on said jig panel.

12. A mortise jig assembly for accurately positioning a recess in a door edge for a hinge plate, said assembly comprising:

a block being longitudinally elongated, said block having a first set of mortises, a second set of mortises, a third set of mortises and a fourth set of mortises, each of said first set mortises, said second set of mortises, said third set of mortises and said fourth set of mortises having a unique offset distance with respect to each other, said block being clamped to a face of a door having said block being aligned with an edge of the door such that a selected one of said first set of mortises, said second set of mortises, said third set of mortises or said fourth set of mortises is aligned with the face of the door, said block having a first end, a second end and an outer surface extending therebetween, said outer surface having a first side, a second side, a third side and a fourth side, said block being elongated between said first end and said second end, said first side being oriented at a right angle with respect to said second side, said second side being oriented at a right angle with respect to said third side, said third side being oriented at a right angle with respect to said fourth side, said fourth side being oriented at a right angle with respect to said first side, said first set of mortises being recessed into said first side, said second set of mortises being recessed into said second side, said third set of mortises being recessed into said third side, said fourth set of mortises being recessed into said fourth side, each of said first set of mortises, said second set of mortises, said third set of mortises and said fourth set of mortises extending between said first end and said second end of said block, each of said first set of mortises, said second set of mortises, said third set of mortises and said fourth set of mortises including a reference mortise, said reference mortise of said first set of mortises being oriented flush with an intersection between said first side and said fourth side of said outer surface, said block having a pair of first holes each extending through said first side and said third side, said block having a pair of second holes each extending through said second side and said fourth side, each of said second holes interesting a respective one of said first holes;

a jig panel having a plurality of jig mortises being recessed therein, said jig panel being positionable against the edge of the door having said jig mortises engaging respective ones of said first set of mortises, said second set of mortises, said third set of mortises or said fourth set of mortises in said block thereby retaining said jig panel at a selected location on the edge of the door, said jig panel having a guide hole therein thereby facilitating said guide hole to be aligned with a preferred location to cut a hinge recess in the edge of the door wherein said block and said jig panel are configured to precisely locate the hinge recess on the edge of the door, said jig panel having a bottom surface, a top surface and a perimeter edge extending therebetween, said perimeter edge having a front side, a back side, a first lateral side and a second lateral side, said plurality of jig mortises being recessed into said bottom surface, each of said jig mortises extending between said first lateral side and said second lateral side, said jig mortises being spaced apart from each other and being distributed between said front side and said back side, each of said jig mortises being spaced apart from each a sufficing distance to facilitate each of said jig mortises to engage either said first set of mortises, said second set of mortises, said third set of mortises or said fourth set of mortises, said guide hole extending through said top surface and said bottom surface, said guide hole being centrally positioned on said jig panel, said guide hole having a bounding edge, said bounding edge having a plurality of intersecting sides such that said guide hole has a rectangular shape, said guide hole being spaced from the face of the door a distance corresponding to said offset of either said first set of mortises, said second set of mortises, said third set of mortises or said fourth set of mortises, said jig panel having a pair of slots each extending through said top surface and said bottom surface, each of said slots extending substantially between said front side and said back side of said perimeter edge of said jig panel, each of said slots being positioned between said guide hole and a respective one of said first lateral side and said second lateral side, each of said slots being aligned with a respective one of said first holes or said second holes when said jig panel is positioned on said block, said top surface having a pair of channels each extending toward said bottom surface, each of said channels extending between said front side and said back side, each of said channels being aligned with a respective one of said slots, each of said channels being oriented collinear with said respective slot;

a pair of bolts, each of said bolts being extendable through said jig panel and said block for attaching said jig panel to said block, each of said bolts being extendable through a respective one of said slots having said bolts extending fully through said respective first hole or said second hole in said block that is aligned with said respective slot, each of said channels in said jig panel accommodating a head of said bolts when said bolts are extended through said respective slot thereby facilitating said head of each of said bolts to be spaced downwardly from said top surface of said jig panel; and a pair of nuts, each of said nuts being threadable onto a respective one of said bolts when said bolts are extended through said jig panel and said block for retaining said block on said jig panel.

* * * * *